US009156277B2

(12) United States Patent
Rossell et al.

(10) Patent No.: US 9,156,277 B2
(45) Date of Patent: Oct. 13, 2015

(54) FLUID EJECTION SYSTEM AND METHOD OF CONTROLLING EJECTION OF FLUID FROM A FLUID EJECTION NOZZLE ARRAY

(75) Inventors: Marti Rius Rossell, Barcelona (ES); Raùl Rodriguez Alonso, Barcelona (ES); Nuria Jornet Jaumot, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 167 days.

(21) Appl. No.: 13/552,881

(22) Filed: Jul. 19, 2012

(65) Prior Publication Data

US 2014/0022297 A1 Jan. 23, 2014

(51) Int. Cl.
*B41J 2/205* (2006.01)
*B41J 2/21* (2006.01)

(52) U.S. Cl.
CPC ..... *B41J 2/2121* (2013.01)

(58) Field of Classification Search
CPC ..... B41J 2/205; B41J 29/38
See application file for complete search history.

(56) References Cited

U.S. PATENT DOCUMENTS

| | | | | |
|---|---|---|---|---|
| 6,328,400 | B1 * | 12/2001 | Yonekubo et al. | 347/15 |
| 6,682,170 | B2 * | 1/2004 | Hotomi et al. | 347/43 |
| 6,783,203 | B2 * | 8/2004 | Fujimori | 347/15 |
| 7,350,902 | B2 * | 4/2008 | Dietl et al. | 347/43 |
| 7,396,097 | B2 * | 7/2008 | Yamazaki et al. | 347/15 |
| 7,588,305 | B2 | 9/2009 | Knierim et al. | |
| 2005/0168506 | A1 * | 8/2005 | Keller et al. | 347/9 |
| 2008/0252673 | A1 * | 10/2008 | Wada et al. | 347/12 |
| 2011/0007107 | A1 * | 1/2011 | Hoisington et al. | 347/12 |

* cited by examiner

*Primary Examiner* — Manish S Shah
*Assistant Examiner* — Jeremy Delozier
(74) *Attorney, Agent, or Firm* — Brooks, Cameron & Huebsch, PLLC

(57) ABSTRACT

The invention relates to a fluid ejection system comprising a print head unit including a fluid ejection nozzle array, wherein the fluid ejection nozzle array comprises at least a first set of nozzles having nozzles of a first fluid ejection capacity and a second set of nozzles having nozzles of a second fluid ejection capacity and nozzles of a third fluid ejection capacity, wherein the first fluid ejection capacity, the second fluid ejection capacity and the third fluid ejection capacity are different from one another, and further including a printer controller which, in a first printing mode, selects nozzles of the first and second sets for firing in proportions so that the overall color densities generated by the nozzles of second set when compared to nozzles of the first set are the same in a defined print area.

19 Claims, 1 Drawing Sheet

FLUID EJECTION SYSTEM AND METHOD OF CONTROLLING EJECTION OF FLUID FROM A FLUID EJECTION NOZZLE ARRAY

BACKGROUND

Printers ejecting fluid from a fluid ejection nozzle array, such as ink jet printers, traditionally feature ink drops of the same size for a given color. The drop size or drop weight normally is chosen as a trade off between printing quality and printing speed. For achieving a high printing quality, such as one having a low drop visibility and small granularity of the printed image, small ink drops are desirable. This, however, goes at the expense of speed which asks for large ink volumes fired per unit time. High speed and through-put which can be achieved using large drop weights. Larger drops also create less aerodynamic effects, such as a distortion or deflection of the ink drop while it is travelling from the print head to the print media. Therefore, there is an apparent contradiction between image quality and printer throughput. One solution to this conflict is the addition of print cartridges including light inks which produce less grain visibility at a given drop weight.

While extra ink cartridges are a solution to the conflict of printing quality and printing speed, they are perceived as added costs and added complexity. Accordingly, dual drop weight print heads have been developed where a single integrated print head enables printing ink jet droplets of different drop weights. Such printers can fire any combination of small or large ink droplets on a given print position wherein the size and combinations of ink droplets are determined by the printer in order to provide an optimum printer quality and speed. Such dual-drop volume print heads eliminate the need for lighter inks, reduce image grain and increase the available color gamut for printing color images.

Further, printing systems are known which create different drop sizes or drop masses by controlling nozzles of the same nozzle geometry with different wave forms of a control voltage.

The present invention is applicable to printers having one or more fluid ejection nozzle arrays, such as ink jet printers, for example photo printers, small and large format technical printers, office and home printers etc.

DETAILED DESCRIPTION

Figure 1:
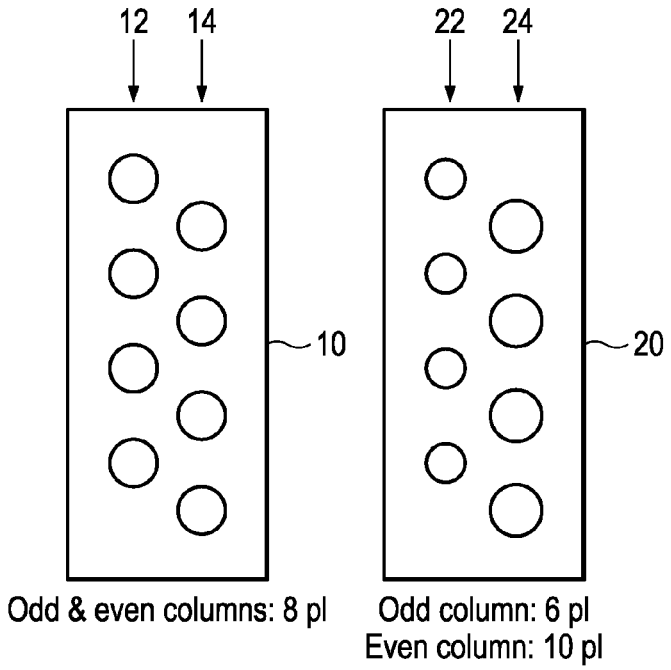
FIG. 1 schematically shows two set of nozzles of a fluid ejection nozzle array which can be used in a fluid ejection system according to one example.

The invention provides a fluid ejection system including a fluid ejection nozzle array and a printer controller, such as in an ink jet printer; a print head system; and a method of controlling ejection of fluid from a fluid ejection nozzle array. The fluid ejection nozzle array comprises at least a first set of nozzles having nozzles of a first fluid ejection capacity (first nozzles) and a second set of nozzles having nozzles of a second fluid ejection capacity (second nozzles) and nozzles of a third fluid ejection capacity (third nozzles). First, second, and third fluid ejection capacities are different from one another. The printer controller, in a first printing mode, selects nozzles of the first and second sets for firing in proportion so that the overall color densities generated by the nozzles of the second set when compared to the nozzles of the first set are the same, in a defined print area. Optionally, in a second printing mode, the printer controller selects nozzles of different fluid ejection capacities for firing in unequal proportions according to defined printing quality criteria. Optionally, in a third printing mode, the printer controller selects nozzles of the fluid ejection nozzle array for firing irrespective of their fluid ejection capacity. Optionally, in a fourth printing mode, the printer controller selects nozzles of only high fluid ejection capacity for printing defined features of an image.

The nozzles of the first set and of the second set can be provided on the same or on different substrates, on one print head or on a group of print heads. The nozzles of different fluid ejection capacities can be nozzles having different nominal sizes. Nozzles of different fluid ejection capacities also can be obtained by providing firing chambers with different orifice-layer thicknesses, different volumes, different-size fluid-energizing elements, and/or laterally offset fluid-energizing elements. By way of example, further details how print heads can be manufactured to have nozzles capable of generating different drop weights are disclosed in US 2006/0007270 A1 of the same applicant; the entire disclosure of this document is incorporated herein by reference. The invention, however, is not limited to these embodiments.

According to a further aspect, the invention provides a method of controlling ejection of a fluid from a fluid ejection nozzle array, the fluid ejection nozzle array comprising at least a first set of nozzles having nozzles of a first fluid ejection capacity (first nozzles) and a second set of nozzles having nozzles of a second fluid ejection capacity (second nozzles) and nozzles of a third fluid ejection capacity (third nozzles). The first, second and third fluid ejection capacities are different from one another. The method includes at least the following options for controlling ejection of fluid from the fluid ejection nozzle array: In a first printing mode, the proportion of firing between the nozzles of the first set and the nozzles of the second set is controlled so that the overall color densities generated by the second set when compared to the first set are the same in a defined print area; in a second optional printing mode, nozzles of different fluid ejection capacities are selected for firing in unequal proportions according to defined printing quality criteria; in a third optional printing mode, nozzles of the fluid ejection nozzle array are selected for firing irrespective of their fluid ejection capacity; and, in a fourth optional printing mode, only nozzles of one specified fluid ejection capacity are selected for printing across a defined area of the print media.

The first printing mode can be a draft mode or fast mode where the fluid ejection nozzle array scans across the same area of a print media e.g. four times or less. By unbalancing the usage of the nozzles of the second set in such a way that the average color density generated by the second set is equal or about equal to the color density generated by the first set, printing of an image with consistent color density can be ensured while still securing a high printing speed and hence a high throughput. In this printing mode, in each pass of the fluid ejection nozzle array across the print media, nozzles of both the first and second set can be used, with the only limitation that the nozzles of the second set are used in such proportions that the average color density generated by the second set is the same as the average color density generated by the first set. If the average fluid ejection capacity of the nozzles of the second set as such is equal to the fluid ejection capacity of the nozzles of the second set, the fluid ejection nozzle array can be controlled for firing with existing printing algorithms, not taking into account the different fluid ejection capacities, because the different drop weights generated by the nozzles having different fluid ejection capacities will even out automatically. If, however, this is not the case, existing printing algorithms can be modified easily by adjusting usage of the nozzles of the second set so that the overall color density generated by the second set of nozzles when compared to the color density generated by the first set of nozzles are the same.

The second printing mode can be a high quality printing mode where the printer makes a larger number of passes across the print media so that it is possible to be more selective about which nozzles to use according to defined printing quality criteria. For example, for printing light colors, it is possible to use only the nozzles of the smallest fluid ejection capacity. In the high quality printing mode, as many as 8 to 10 passes or more across each area of the print media is performed so that each pixel can be printed using only nozzles of small fluid ejection capacity, i.e. using only a selected part of the nozzles of the fluid ejection nozzle array, if necessary. An example of the second printing mode is described further below.

The third printing mode, in turn, can be a draft mode or fast mode, where the fluid ejection nozzle arrays scans across the same area of the print media only a few times, such as four times or less. In this third printing mode, color density is not a concern and the printer controller can select any nozzles of the fluid ejection array for firing irrespective of their fluid ejection capacity. This probably is the fastest printing mode where existing printing algorithms can be used, although at the potential risk of creating printed areas of uneven color density. This, however, should not be a concern in a printing mode where printing speed has highest priority.

There can be additional printing modes where only nozzles of a defined fluid ejection capacity or only one of the two sets of nozzles are used for printing particular features. For example, for printing fully colored bars or lines, it might be desirable to use only nozzles of the largest fluid ejection capacity. In another example, for printing very fine lines, it might be advisable to use only nozzles of the smallest fluid ejection capacity.

In one example of the invention, the nozzles to be fired are determined by the combination of a halftone scheme and a masking scheme. The halftone scheme determines a halftone value for each of a number of pixels of an image to be printed, and the masking scheme determines, for each pixel, which of a number of nozzles is to be used for printing said pixel. If, for example, the halftone value indicates a light color, the masking scheme would select a nozzle having a small fluid ejection capacity. The masking scheme then determines which nozzle is to be used to print on which part of the print media in which pass. Halftone algorithms and masking algorithms, as such, are known in the art but have not been used for unbalancing the firing of nozzles having different fluid ejection capacities. In particular, the known masking algorithms have not been employed for unbalancing the use of nozzles having different fluid ejection capacities for obtaining a balanced color density.

According to a further aspect, a print head system is provided, the print head system including a fluid ejection nozzle array, such as for an ink jet printer. The fluid ejection nozzle array comprises a first set of nozzles having nozzles of a first fluid ejection capacity (first nozzles) and a second set of nozzles having at least one nozzle of a second fluid ejection capacity (second nozzles) and at least one nozzle of a third fluid ejection capacity (third nozzles). The first, second, and third fluid ejection capacities are different from one another wherein the average of the second and third fluid ejection capacities is equal to the first fluid ejection capacity.

The average fluid ejection capacity of the second set of nozzles is determined by the second and third fluid ejection capacities of its associated nozzles and the total number of nozzles in each group of nozzles. In one example, the number of second nozzles equals the number of third nozzles and is half the number of first nozzles. In one specific example, the average of the fluid ejection capacity of a pair of second and third nozzles equals the fluid ejection capacity of one first nozzle.

For example, the first set of nozzles can have nozzles of a first size and the second set of nozzles can have nozzles of second and third sizes. Assuming that the first and second sets of nozzles comprise the same number of nozzles, the average of the second and third nozzle sizes should then be the same as the first nozzle size. This is explained in further detail by way of example, below.

The first and second sets of nozzles can be provided on a common print head substrate or on separate print head substrates. If the two set of nozzles are provided on separate print head substrates, these print head substrates can be mounted on a common print head or on separate print heads. Separate print heads could be used alternatively or in combination.

The fluid ejection system unbalances the usage of nozzles of different fluid ejection capacities, generating different drop weights, so as to generate an even color density in a fast printing mode, or to meet defined printing quality criteria, such as small drop visibility. Having nozzles of different fluid ejection capacity and unbalancing nozzle usage allows to select the best nozzle for printing particular features, in a high quality printing mode where a larger number of passes across the print area are available. For example, light colors can be printed exclusively with small nozzles and dark colors can be printed with large nozzles. In each pass, the most appropriate nozzle for a particular purpose can be selected by unbalancing the usage of nozzles. On the other hand, in a draft printing mode or fast printing mode, the usage of the nozzles in the two sets of nozzles can be unbalanced so that a print-out having consistent color density is achieved at a high printing speed and hence at a high throughput.

FIG. 1 schematically shows two sets of nozzles of a fluid ejection nozzle array having different fluid ejection capacities. The two sets of nozzles are shown on two separate print head substrates 10, 20, both print head substrates comprising two columns of nozzles. A first print head substrate 10 comprises odd and even columns 12, 14 including nozzles of equal fluid ejection capacity or nozzle size. By way of example, each nozzle can eject a drop having a drop volume of 8 picoliter (pl). The second print head substrate 20 comprises two columns 22, 24 of nozzles of unequal fluid ejection capacity or nozzle size. By way of example, the first column 22 comprises nozzles ejecting a drop volume of 6 picoliter (pl) and column 24 comprises nozzles ejecting a drop volume of 10 picoliter (pl). Instead of providing the two sets of nozzles on to separate substrates 10, 20, it is also possible to combine the different sets of nozzles on a single substrate, as will be explained further below.

It is noted that in the example shown in FIG. 1, the average drop volume of the second set of nozzles on the second substrate 20 equals the average drop volume of the first set of nozzles on the first substrate 10. While this is one example of the invention, the invention is not limited to this example because averaging of drop weights or drop volumes can also be achieved by unbalancing the usage of nozzles of other relative fluid ejection capacities. This averaging of drop weights preferably is made over the total number of nozzles provided in a fluid ejection nozzle array.

The two fluid ejection nozzle arrays shown in FIG. 1 can be used alongside for forming a print head on a common print cartridge or can be provided on two different print cartridges which are used in a common printer in combination or alternatively.

Figure 2:
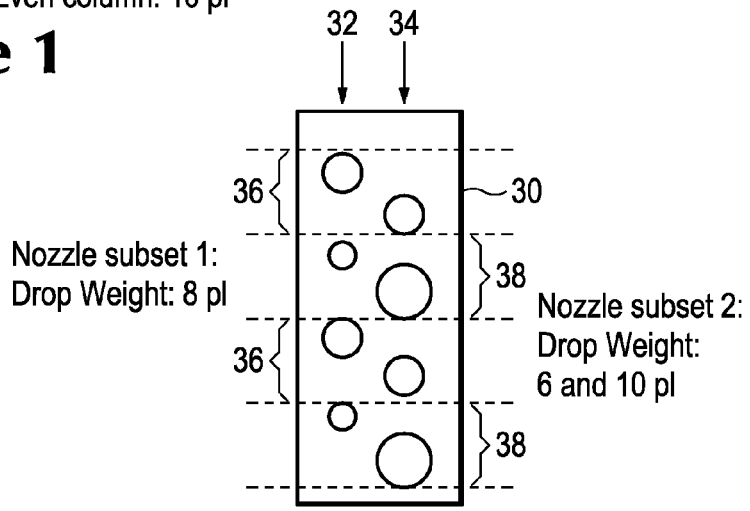
FIG. 2 schematically shows two set of nozzles of a fluid ejection nozzle array which can be used in a fluid ejection system according to another example.

FIG. 2 shows an alternative example for arranging the two sets of nozzles on a common substrate 30; also in this example the nozzles are arranged in two columns 32, 34. The fluid ejection nozzle array provided on the common substrate 30 is divided into a number of sections along the media advance direction, each section comprising two nozzles of either the first set or the second set. The sections comprising nozzles of the first set are designated 36 in FIG. 1 and the sections comprising nozzles of the second set are designated 38. Sections 36, in this example, each comprise two nozzles of the first set of nozzles having a first nozzle size or fluid ejection capacity; and the other sections 38 each comprise two nozzles of the second set of nozzles having different second and third sizes or fluid ejection capacities. By way of example, the nozzles of the first set in sections 36 eject droplets having a weight of 8 pl and the nozzles of the second set in sections 38 comprise nozzles ejecting droplets of unequal drop weights of 6 pl and 10 pl. It is possible to provide for different arrangements of the first and second sets of nozzles on a common substrate and FIG. 2 should be understood as one example only.

Also, in the example shown in FIG. 2, the average size or fluid ejection capacity of the nozzles of the second set equals the size or fluid ejection capacity of the nozzles of the first set. However, this does not need to be the case as the same effect of producing equal color densities by ejecting drops from the first and second set can be achieved by an unbalanced firing of the nozzles of the first and second sets.

Figure 3:
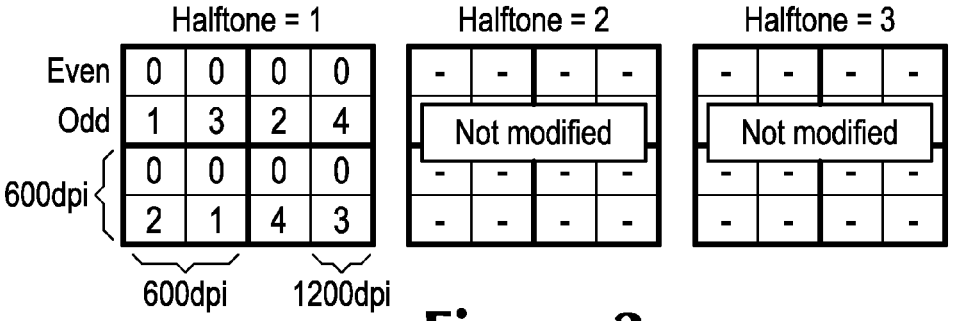
FIG. 3 schematically shows printing masks for determining firing of nozzles according to a halftone algorithm in the fluid ejection system according to one example.

FIG. 3 schematically shows printing masks for determining firing of nozzles according to a halftone scheme in the fluid ejection system. The printing mask shown in FIG. 3 can be used in combination with the print head substrate 20 of FIG. 1. For clarity reasons, the example of FIG. 3 is based on a fluid ejection nozzle array having only two different types of nozzles having different fluid ejection capacities or sizes. The same principle, however, can also be used for fluid ejection nozzle arrays having three or more different types of nozzles.

When printing a halftone picture, for each pixel to be printed, a halftone value is determined. In this example, halftones having a value of 1, 2, and 3 are used for designating lighter, medium, and darker color areas. Halftone value "1" hence indicates a light color which preferably should be printed by a number of small dots.

In the example of FIG. 3, when the halftone value is 1, indicating a light color, the printing mask is determined so that each pixel is printed only from nozzles of odd column, such as column 22 of print head substrate 20. Accordingly, only small or low-capacity nozzles are used for printing. The numbers 1, 2, 3, 4 in the masking scheme indicate which of the odd column nozzles is used in which pass of a print head over a print media. As only one half of the total number of nozzles are used, the halftone vertical resolution will be half of the maximum resolution; for example, in a printer having a resolution of 1200 dpi, the physical printing resolution will be of 600 dpi with the masking scheme of FIG. 3 but by using incremental print media advances (described below), the effective printing resolution can be increased.

For higher halftone values, such as 2 or 3, indicating darker color areas, drop visibility and granularity is less of a concern so that it could be possible to use existing masks even for a modified print head having nozzles of different fluid ejection capacities or sizes. If the nozzles of the second set have the same average fluid ejection capacity as the nozzles of the first set, existing masks will achieve the same color density as before. If this is not the case, existing masks could be modified so as to unbalanced the usage of the nozzles of the second set so that the first and second sets of nozzles produce the same color density and hence an even appearance of the printed image is obtained.

It is also possible to use specific masks for high halftone values, such as 3, indicating dark colored area. The mask matrix could be adjusted so that only or mainly large nozzles are used, i.e. only or mainly nozzles of the even column 24 of substrate 20. This unbalanced use of nozzles allows to fire the same quantity of ink with a lower average firing frequency and hence allows to avoid thermal problems. For example, large nozzle print heads are known to be more thermally efficient, i.e. the same amount of ink can be ejected using a lower amount of energy. Also this characteristic can be taken advantage of by an unbalanced usage of the nozzles of the fluid ejection nozzle array.

Further, specific masking schemes can be used for printing defined features of an image, such as lines or fully black areas. For example, if the nozzles of high fluid ejection capacity have a better decap performance, lines or fully black areas could be printed with those nozzles. It is known that, for example, ink jet nozzles have a tendency of "drying out", where the ink viscosity increases after the nozzles have been uncapped for an extended period of time. It is also known that larger nozzles are less sensitive to this phenomenon. Therefore, if the image to be printed allows, it is possible to give priority to firing with larger nozzles using respective masking schemes to improve decap performance.

Also a defect known as "aerodynamic worms", which appears mainly in midtone areas in fast printing modes, could be mitigated by shifting the usage towards larger nozzles. A distortion or deflection of ink droplets and unwanted artifacts of the printed image caused thereby hence can be avoided.

Line thicknesses could be fine-tuned by printing thin, high quality lines only with small nozzles.

Modifying printing masks to achieve an unbalanced usage of nozzles might induce non-linearities between the halftone values at a quantity of ink; i.e. the conversion between halftone data and the related ink quantity is non-linear; two drops are not twice as dark as one drop. These effects can be compensated with linearization modules which, as such, are known.

Depending on the print head configuration, in multiple pass print modes, the print media can be advanced through the print zone by M+1 nozzle pitches, wherein M is an even number. It is also possible to advance the print media by unequal distances between successive passes of a print head. In one example, depending on the print mode, it shall be possible to advance the print media in such a way that any piece of the print media can be printed by first, second and third nozzles in consecutive passes so as to obtain a maximum printing resolution. In a printing mode, where the input resolution is the same as the pen firing resolution, such as 1200 dpi×1200 dpi, it even would be possible to use only the smallest or lowest firing capacity nozzles and get the full resolutions by using passes of M+1 nozzles.

While the present application has been described with reference to two sets of nozzles wherein the first set comprises nozzles of a first fluid ejection capacity and the second set comprises nozzles of second and third fluid ejection capacities, the invention is not limited to these embodiments. Both sets of nozzles can comprise additional groups of nozzles having different fluid ejection capacities and additional sets of nozzles can be provided in the same or in additional print head substrates. The definition that the fluid ejection nozzle array comprises two sets of nozzles hence does not limit the invention to exactly two sets but additional nozzle sets can be provided. Further, the definition that the second set of nozzles comprises two groups of nozzles of first and second fluid ejection capacities also does not limit the invention to exactly two such nozzle groups.

What is claimed is:

1. A fluid ejection system comprising a print head unit including a fluid ejection nozzle array, wherein the fluid ejection nozzle array comprises at least a first set of nozzles having nozzles of a first fluid ejection capacity and a second set of nozzles having nozzles of a second fluid ejection capacity and nozzles of a third fluid ejection capacity, wherein the first fluid ejection capacity, the second fluid ejection capacity and the third fluid ejection capacity are different from one another, wherein the nozzles of the first, second and third nominal fluid ejection capacities have different nominal sizes, and further including a printer controller that unbalances the usage of nozzles of the first and second sets with different fluid ejection capacities to generate drops having different drop weights, in a first printing mode, through selection of nozzles of the first and second sets for firing in proportions so that the overall color densities generated by the nozzles of second set when compared to nozzles of the first set are the same in a defined print area.

2. The fluid ejection system of claim 1 wherein, in a second printing mode, the printer controller selects nozzles of different fluid ejection capacities for firing in unequal proportions according to defined printing quality criteria.

3. The fluid ejection system of claim 1 wherein, in a third printing mode, the printer controller selects nozzles of the fluid ejection nozzle array for firing irrespective of their fluid ejection capacity.

4. The fluid ejection system of claim 1 wherein the number of nozzles of the first set is equal or about equal to the number of nozzles of the second set.

5. The fluid ejection system of claim 1 wherein the print head unit comprises at least one print head including the first and second sets of nozzles.

6. The fluid ejection system of claim 1 wherein the print head unit comprises at least two print heads, a first print head including the first set of nozzles and a second print head including the second set of nozzles, wherein the first and second print heads can be used in combination or alternatively.

7. A method of controlling ejection of a fluid from a fluid ejection nozzle array, wherein the fluid ejection nozzle array comprises at least a first set of nozzles having nozzles of a first fluid ejection capacity and a second set of nozzles having nozzles of a second fluid ejection capacity and nozzles of a third fluid ejection capacity, wherein the first fluid ejection capacity, the second fluid ejection capacity and the third fluid ejection capacity are different from one another, the method comprising the step of:

in a first printing mode, unbalancing the usage of nozzles of the first and second sets with different fluid ejection capacities to generate drops having different drop weights through controlling the proportion of firing between the nozzles of the first set and the nozzles of the second set so that the overall color density generated by the second set when compared to the color density generated by the first set are the same in a defined print area.

8. The method of claim 7 wherein, in a second printing mode, nozzles of different fluid ejection capacities are selected for firing in unequal proportions according to defined printing quality criteria.

9. The method of claim 7 wherein, in a third printing mode, nozzles of the fluid ejection nozzle array are selected for firing irrespective of their fluid ejection capacity.

10. The method of claim 7 wherein the first printing mode is a draft mode where the fluid ejection nozzle array scans across the same area of a print media four times or less.

11. The method of claim 8 wherein the second printing mode is a high quality mode where the fluid ejection nozzle array scans across the same area of a print media four times or more.

12. The method of claim 8 wherein, in the second printing mode, nozzles having a low fluid ejection capacity are selected for printing light colored areas to reduce drop visibility.

13. The method of claim 7 wherein, in a fourth printing mode, only nozzles of one specified fluid ejection capacity are selected for printing across the same area of a print media in four scans or less.

14. The method of claim 7 wherein a halftone scheme determines a halftone value for each of a number of pixels of an image to be printed;

a masking scheme, for each pixel, determines which of a number of nozzles is to be used for printing said pixel;

wherein, when the halftone value is indicating a light color, the masking scheme selects a nozzle having a small fluid ejection capacity.

15. The method of claim 14 wherein, when the halftone value is indicating a dark color, the masking algorithm selects a random nozzle having any fluid ejection capacity.

16. The method of claim 9 wherein, for printing predefined features of an image, only nozzles of the first set of nozzles, or only nozzles of the second set of nozzles are selected for ejecting fluid.

17. A print head system including a fluid ejection nozzle array, wherein the fluid ejection nozzle array comprises a first set of nozzles having nozzles of a first fluid ejection capacity and a second set of nozzles having at least one nozzle of a second fluid ejection capacity and at least one nozzle of a third fluid ejection capacity, wherein the first fluid ejection capacity, the second fluid ejection capacity and the third fluid ejection capacity are different from one another, the nozzles of the first, second and third nominal fluid ejection capacities have different nominal sizes, and the average of the second fluid ejection capacity and third fluid ejection capacity is equal to the first fluid ejection capacity.

18. The print head system of claim 17 wherein the first and second sets of nozzles are provided on a common print head.

19. The print head system of claim 18 wherein the first and second sets of nozzles are provided on first and second print heads which are used alternatively or in combination in a fluid ejection device.

* * * * *